US007020985B2

(12) United States Patent
Casey et al.

(10) Patent No.: US 7,020,985 B2
(45) Date of Patent: Apr. 4, 2006

(54) MULTIPLE OUTLET AIR PATH FOR A CLOTHES DRYER

(75) Inventors: Steven Michael Casey, Arlington, MA (US); David Michael Martin, Agawam, MA (US); John Thomas Dieckmann, Belmont, MA (US); Peter Francis Pescatore, Wakefiled, MA (US); Philip C. Carbone, North Reading, MA (US); Warren James Ellis, Jr., Worcester, MA (US); Frederick E. Chernetski, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/952,422

(22) Filed: Sep. 28, 2004

(65) Prior Publication Data

US 2005/0210698 A1 Sep. 29, 2005

Related U.S. Application Data

(60) Provisional application No. 60/557,073, filed on Mar. 26, 2004.

(51) Int. Cl.
*F26B 11/02* (2006.01)

(52) U.S. Cl. ..... 34/595

(58) Field of Classification Search ..... 34/595, 34/596, 598, 599, 600, 601
See application file for complete search history.

(56) References Cited

U.S. PATENT DOCUMENTS

| | | | | |
|---|---|---|---|---|
| 2,931,687 | A * | 4/1960 | Mitter | 312/323 |
| 4,621,438 | A * | 11/1986 | Lanciaux | 34/77 |
| 5,228,212 | A * | 7/1993 | Turetta et al. | 34/493 |
| 5,343,632 | A * | 9/1994 | Dinh | 34/507 |
| 2005/0199016 | A1 * | 9/2005 | Tadano et al. | 68/18 C |

FOREIGN PATENT DOCUMENTS

| | | | | |
|---|---|---|---|---|
| JP | 6-63296 | * | 3/1994 | 34/595 X |

OTHER PUBLICATIONS

Internet List Server discussion of heat pump clothes dryers from Jul. 2001.*

* cited by examiner

*Primary Examiner*—S. Gravini
(74) *Attorney, Agent, or Firm*—John F. Colligan; Robert O. Rice; Stephen Krefman

(57) ABSTRACT

A clothes dryer has a heat source, preferably a heat pump, a rotating drum, and means to generate flow of air from the heat source to an inlet in the drum. At least two outlets are separated from each other in the drum to enable higher air flow rates without increase in pressure drop, resulting in reduced drying time.

20 Claims, 7 Drawing Sheets

MULTIPLE OUTLET AIR PATH FOR A CLOTHES DRYER

This patent application claims the benefit of Provisional application 60/557,073, filed Mar. 26, 2004.

BACKGROUND OF THE INVENTION

1. Field of the Invention

The invention relates to electric clothes dryers and more particularly to the airflow paths within the dryer.

2. Description of the Related Art

Laundry areas in homes are moving out of the basement. The trend in many newer homes is to integrate complete laundry centers into the living space, typically at a considerable expense. Combining this trend with a greater awareness of energy conservation, especially water conservation, has led to a significant increase in demand for high-end front-loading washing machines with many consumer-focused performance attributes. Meanwhile, in general, the clothes dryer has changed very little.

Most standard electric dryers available today in North America operate with a resistance-type heating element at a fixed wattage and a fixed airflow rate (varying only in response to load size and venting configurations that create a system pressure drop). The element typically operates in an on/off mode as determined by the cycle chosen and the temperature of the exhaust flow. Many dryers integrate a type of moisture sensor, the most common being conductivity strips, to assist in identifying when to terminate a cycle. These strips serve to measure gross detection of whether the load is wet or not and typically do not quantify how wet or how dry.

Heat pump dryers are more common in Europe and do a very good job of delivering significant energy savings. A schematic diagram, illustrating the typical components of a heat pump dryer 10, is shown in FIG. 1. The heat pump dryer 10 comprises a compressor 12 with a refrigerant circulation loop 14 connected to a condenser 16 and an evaporator 18. The refrigerant circulating in the refrigerant circulation loop 14 is typically R-22. Air flow is generated by a fan 20 and follows an airflow path 22 through a drum 24 and a lint filter 26. The air is treated in the evaporator 18 and the condenser 16, and then typically recirculated to the fan 20. The evaporator 18 removes a significant portion of the moisture in the air before it flows through the condenser 16 and back to the fan 20.

FIG. 2 schematically shows airflow through the drum 24. Process air from the fan 20 is hot and dry as it enters the drum 24 at an inlet 28, normally at the rear of the drum. The process air interacts with the clothes in the load where it picks up moisture from the load. The moist air, still warm, then exits the drum 24 through an outlet 30, usually at the front of the drum, where it proceeds through the lint filter 26.

Heat pump dryers tend to have very long dry times, which make them unacceptable in the North American market. In some cases, the dry time for a large load is almost twice as long in a heat pump dryer as it is in a standard U.S. electric dryer. There is a need for more energy efficient clothes dryers in North America. One solution is to provide an energy efficient heat pump dryer that delivers reasonable dry times.

Reducing dry times in heat pump dryers might be accomplished, for example, by increasing inlet air temperature and/or increasing airflow through the drum. But these solutions lead to other problems. Air temperatures from a heat pump are essentially limited by the choice of refrigerant.

Standard R-22 based heat pump systems do not lend themselves to delivering high temperatures. Under the conditions expected in a clothes dryer, maximum R-22 condenser temperatures are around 150° F. To achieve faster dry times in a heat pump dryer based on higher air temperature, the condenser temperature needs to be higher.

Higher airflow through the drum is easily achievable, but clothes plastering to the outlet grill in the dryer's drum is a significant concern. Standard dryers operate with approximately 100 cfm of airflow. As airflow exceeds 200 cfm, increased pressure drop across the drum tends to cause clothing in the drum to be drawn onto the outlet grill and held in place, which creates a significant problem in maintaining adequate air flow. Added to this complication is the likelihood of lint migration beyond the lint screen into the region of the heat exchangers due to increased airflow. This creates problems for system geometry and the design of the heat exchangers and heat transfer apparatus.

These problems are not limited to heat pump dryers. In conventional electric dryers, increasing air temperature comes at the cost of greater energy expenditure. Also, the problem of clothes plastering to the outlet grill with increased airflow remains.

SUMMARY OF THE INVENTION

These problems and others are solved by the present invention of a clothes dryer comprising a heat pump, a drum, an inlet in the drum fluidly connecting the heat pump to the drum, and first and second outlets in the drum. Each outlet is covered by a grill, and spaced from the other and from the inlet to exhaust air from the drum. A fan is provided for generating a flow of air from the heat pump into the drum through the inlet and out of the drum through the first and second outlets. With this structure, the velocity of the flow of air can be increased through the drum with minimal pressure drop between the inlet and the outlets to accelerate drying clothes in the drum with less plastering of clothes against the grill at either of the outlets.

In one aspect, the drum comprises a rear bulkhead, a front bulkhead, and an intermediate rotatable tumbler. The first outlet is disposed in the front bulkhead and the second outlet is disposed in the rear bulkhead. The sum of the cross sectional areas of the first and second outlets should be greater than the cross sectional area of the inlet. Preferably, the sum of the cross sectional areas of the first and second outlets is at least twice the cross sectional area of the inlet.

Typically, the first and second outlets will be fluidly connected outside the drum to a common plenum. As well, the plenum will preferably be disposed between the outlets and a lint filter.

DETAILED DESCRIPTION

Figure 1:
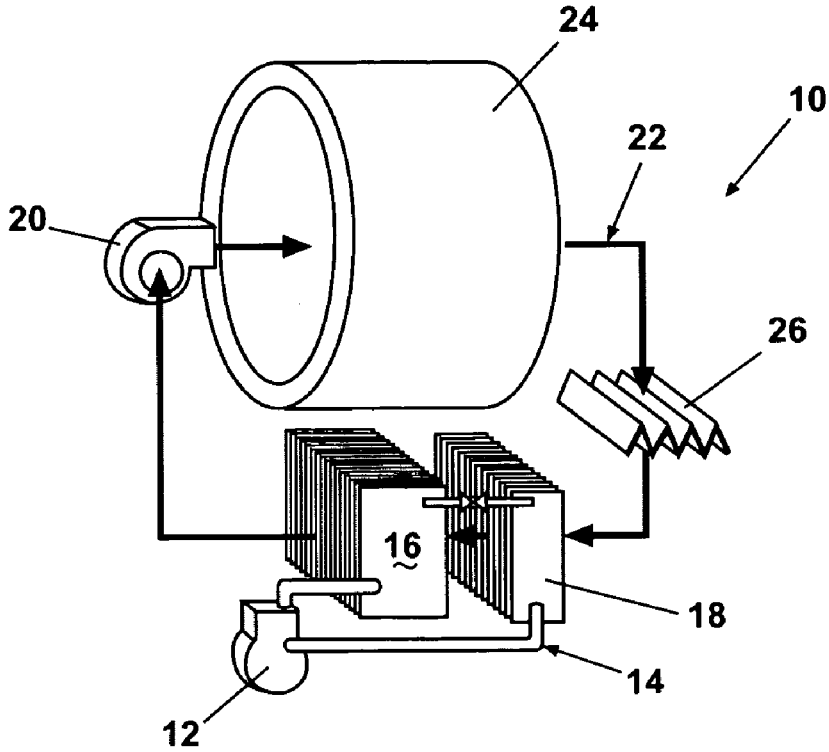
Fig. 1 (PRIOR ART)
FIG. 1 shows in schematic form an exemplary heat pump dryer of the prior art.
Figure 2:
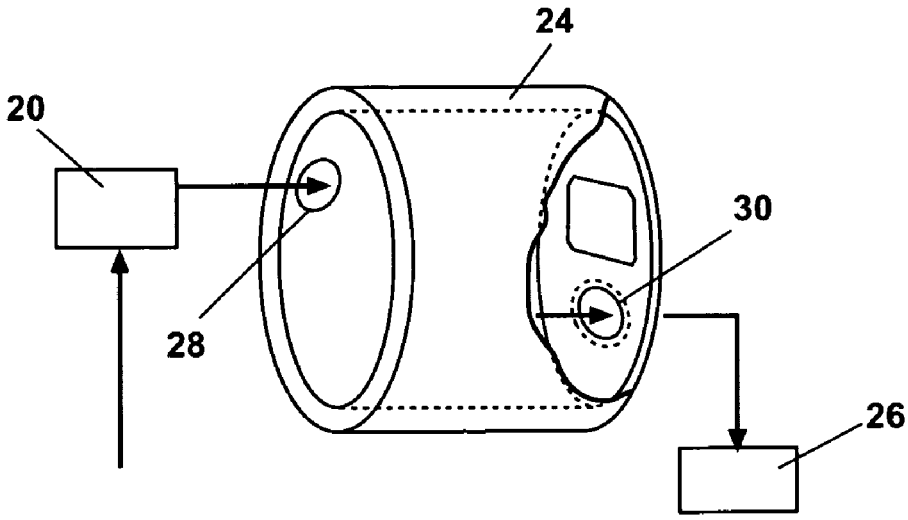
Fig. 2 (PRIOR ART)
FIG. 2 is a schematic view of the drum of the heat pump dryer of FIG. 1, showing airflow therethrough.

The invention relates to the air flow path through the drum of a dryer. A preferred embodiment, as set forth herein, appears in a heat pump dryer having an overall configuration not unlike that shown in FIG. 1. For the heat pump embodiment according to the invention, it was found desirable to incorporate most of the components associated with a heat pump system (compressor, evaporator, condenser, tubing, etc.) into a conventional resistance heater dryer cabinet. Preferably, the heat pump will draw 2.2 Kilowatts of power utilizing 250 cfm of airflow.

A reciprocating compressor is preferred, mainly for reliability reasons. The pressure ranges under which normal operation occurs (in order to maximize condenser temperatures) suggest the use of a more reliable reciprocating compressor. A rotary compressor design is an acceptable alternative, if reliability is not a primary concern.

Figure 3:
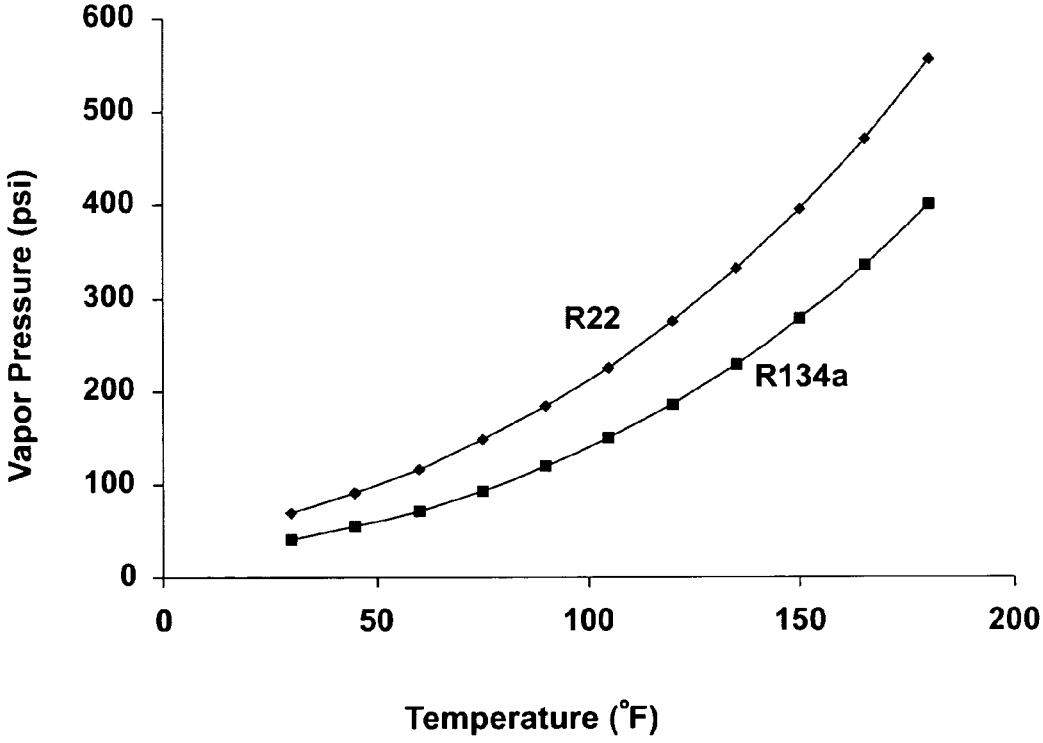
FIG. 3 graphically shows the effect of refrigerant selection on condensing temperatures.

In order to achieve the highest possible air temperatures, the preferred embodiment uses R-134a refrigerant in an R-22 AC/Heat Pump compressor. The use of R-134a serves to shift the evaporating and condensing temperatures by about 30° F. with similar operating pressures and power input. This effect is shown in FIG. 3. By using the R-134a refrigerant, the condensing temperature is increased from 150 to 180° F., resulting in higher temperatures for the dryer's process air and in turn, faster dry times.

Figure 4:
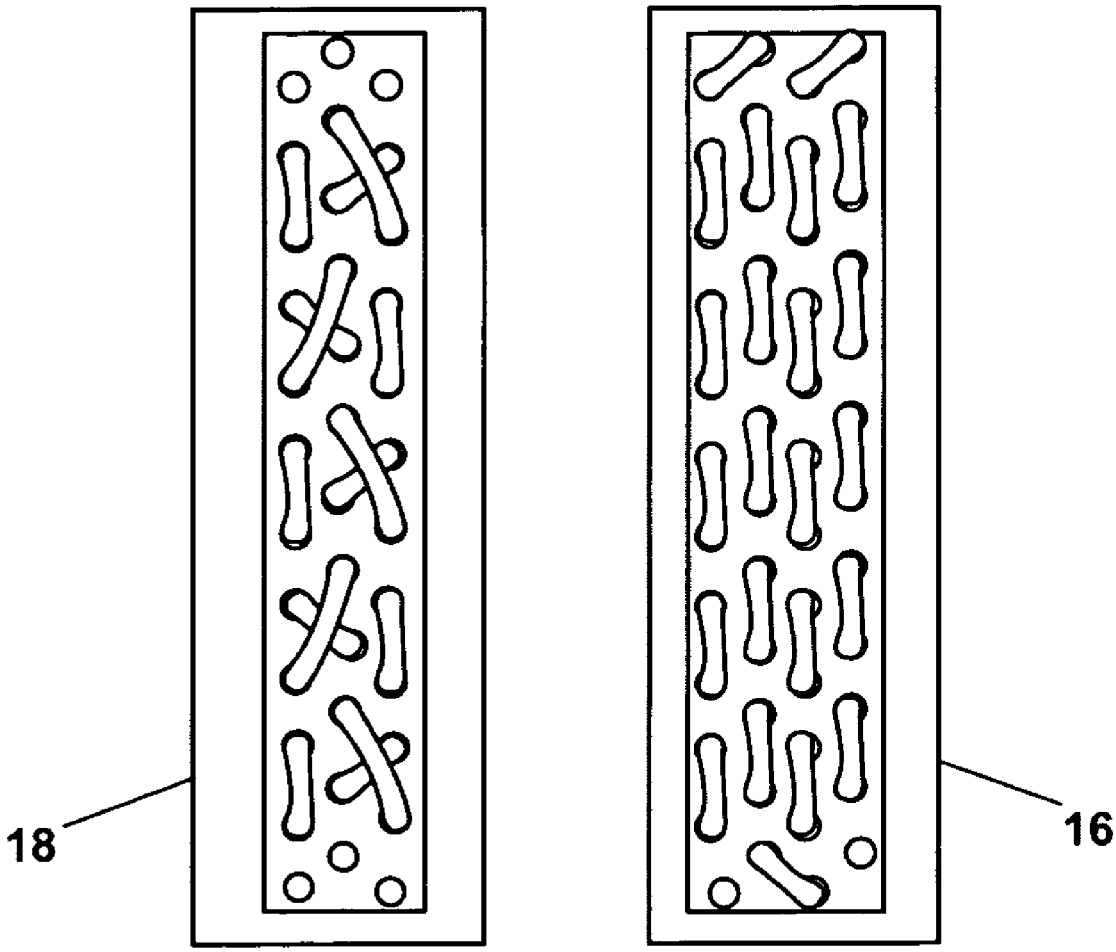
FIG. 4 shows end views of evaporator and condenser designs for a heat pump dryer according to the invention.

FIG. 4 shows end views of an exemplary configuration of the evaporator 18 and condenser 16 used in the embodiment. The evaporator is sized for a high latent load. In addition, the evaporator 18 is designed to limit lint migration beyond its inlet face. Preferably, the evaporator 18 employs multiple circuits and multiple rows in the heat exchanger to minimize pressure drop. In the illustrated embodiment, three circuits are shown.

Similarly, the condenser 16 is configured to maximize heat transfer. An enhanced fin design uses a single circuit employing counter flow circuitry to maximize efficiency. The circuit is also sized with sufficient length to allow for proper sub cooling.

The typical drying process is generally considered to have four phases. These are the warm-up phase, the constant drying rate phase, the falling rate phase and cool down. The moisture removal rate for each of these phases is different. This means the latent load on the evaporator varies throughout the cycle. To account for this variation in heating load throughout the dry cycle, a thermal expansion valve can be used. A thermal expansion valve serves to control the refrigerant flow to the evaporator over the different phases of the dry cycle for a wide variety of clothing loads. The resultant performance provides low superheat and maximum efficiency for the system. Charging the system with substantial subcooling at the condenser outlet further optimizes efficiency.

While the foregoing improvements help achieve shorter drying times without unduly sacrificing efficiency, it has been found that increasing airflow rates through the drum has a significant positive impact on drying times while actually reducing energy consumption. Such reductions occur with the invention because less power is needed to operate the fan over the complete cycle, clothes dry more efficiently inside the drum, and the overall drying time is shorter. Although these benefits are shown in the exemplary embodiment of the heat pump dryer, the can also be achieved on any dryer, including an electric dryer of conventional North American configuration.

Figure 5:
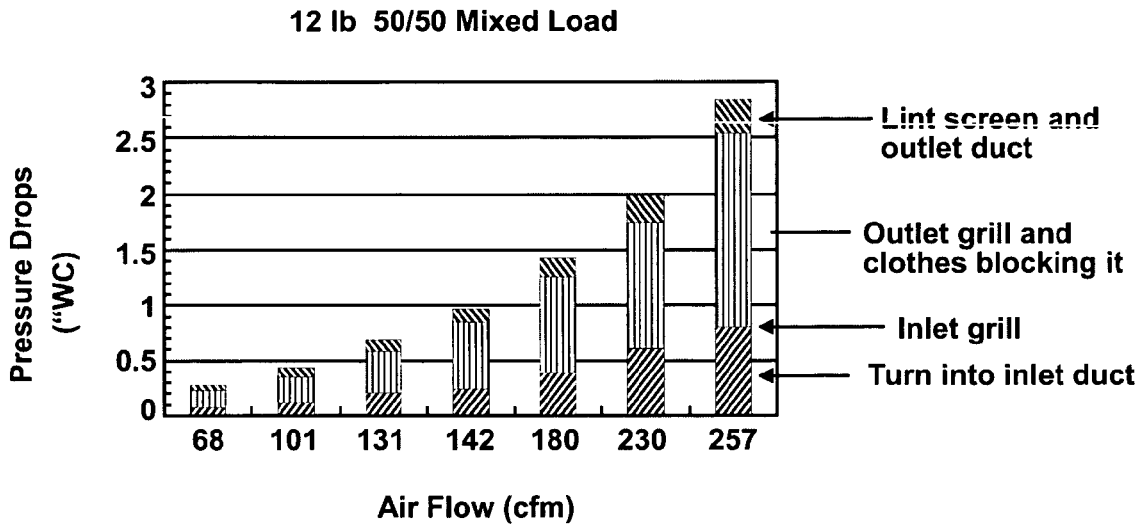
FIG. 5 graphically shows pressure drop vs. flow rate in a dryer without the invention.
Figure 6:
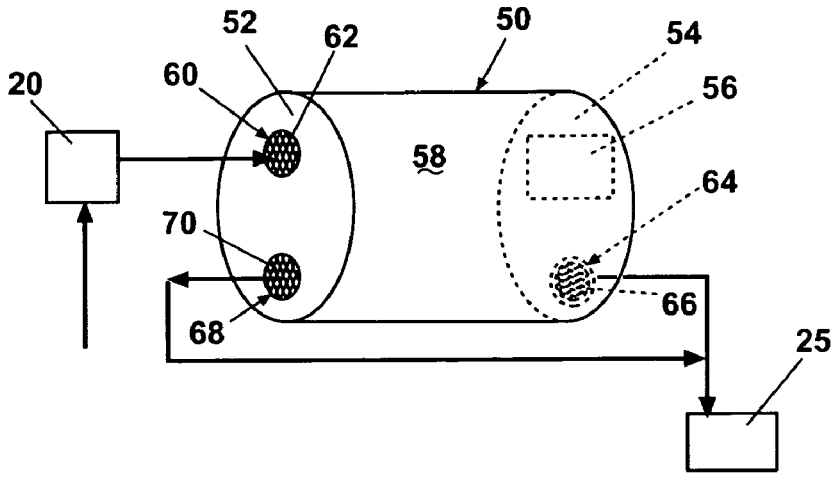
FIG. 6 is a schematic view of a drum of clothes dryer, showing airflow therethrough according to the invention.
Figure 7:
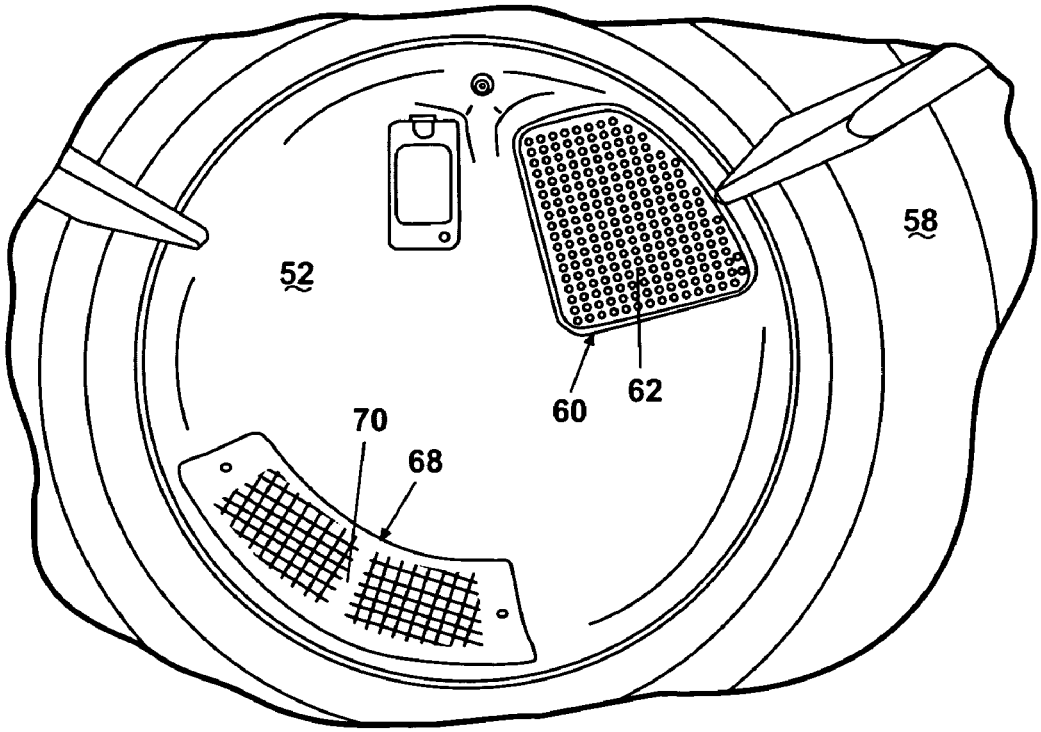
FIG. 7 is a front view of a dryer drum of the type shown in FIG. 6 showing placement of a second outlet port according to the invention.
Figure 8:
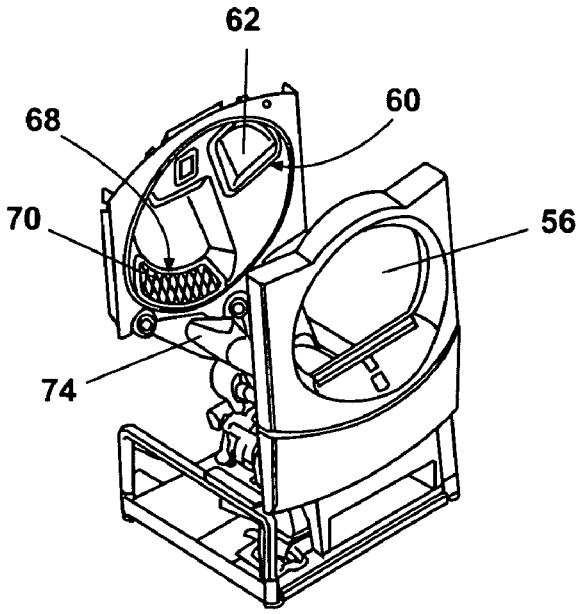
FIG. 8 is a front perspective view of a dryer, with parts removed.
Figure 9:
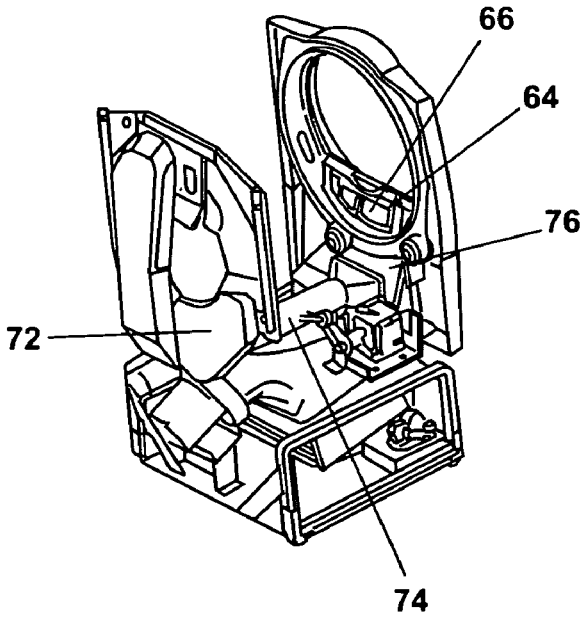
FIG. 9 is a rear perspective view of the dryer of FIG. 8, with parts removed.

As noted earlier, maximum airflow rates are desired in order to maximize heat output from the heat pump. It was found that an airflow rate of 250 cfm provides good drying time for the heat pump dryer embodiment according to the invention. However, this airflow rate presents problems with fabric plastering, as detailed earlier, and system pressure drop. FIG. 5 shows the measured pressure drops in the airflow of a dryer system, without the invention, for varying flow rates as measured between just before the inlet and just after the outlet of a drum. It also shows how much of the pressure drop is attributable to different causes. It is seen that pressure drops approaching 3" WC are realized at flows around 250 cfm in the tested embodiment. To achieve the target flow rates at these pressure drops, the blower system not only becomes prohibitively expensive and oversized, but the energy consumption becomes unacceptable. It can also be seen that the largest impact on pressure drop comes from clothes plastering on the outlet grill.

Turning now to FIGS. 6–9, an improved airflow path is provided in a clothes dryer drum by the addition of at least one additional outlet, in accordance with the invention. A drum 50 has a rear bulkhead 52 and a front bulkhead 54. An access opening 56 is typically provided in the front bulkhead 54 and adapted to be covered by a door (not shown) in conventional manner. It will be understood that, in overall configuration, the drum 50 is conventional in that the rear and front bulkheads 52, 54 are stationary, and that a tumbler 58, intermediate the rear and front bulkheads, is rotatably mounted to cause clothes loaded into the drum to tumble as the tumbler rotates. An inlet port 60 is preferably disposed at an upper portion of the rear bulkhead 52, covered by an inlet grill 62. A first outlet port 64 is disposed at a lower portion of the front bulkhead 54, covered by an outlet grill 66. A second outlet port 68 is disposed at a lower portion of the rear bulkhead 52, covered by an outlet grill 70. Preferably, the cross-sectional area of the first and second outlet ports 64, 68 is approximately twice the cross-sectional area of the inlet port 60.

The second outlet port 68 is connected to a plenum 72 mounted to the outside of the rear bulkhead 52. The plenum 72 is connected to a duct 74 that extends toward the front of the dryer. The first outlet port 64 is also connected to a plenum 76 that is fluidly connected to the duct 74. Outlet air from the second outlet port 68 enters the plenum 72 and then moves through the duct 74 from the rear to the front of the dryer. Meanwhile, outlet air from the first outlet port 64 enters the plenum 76, where it meets the outlet air from the second outlet port 68 before flowing through a lint filter, and then to a heat exchanger.

Figure 10:
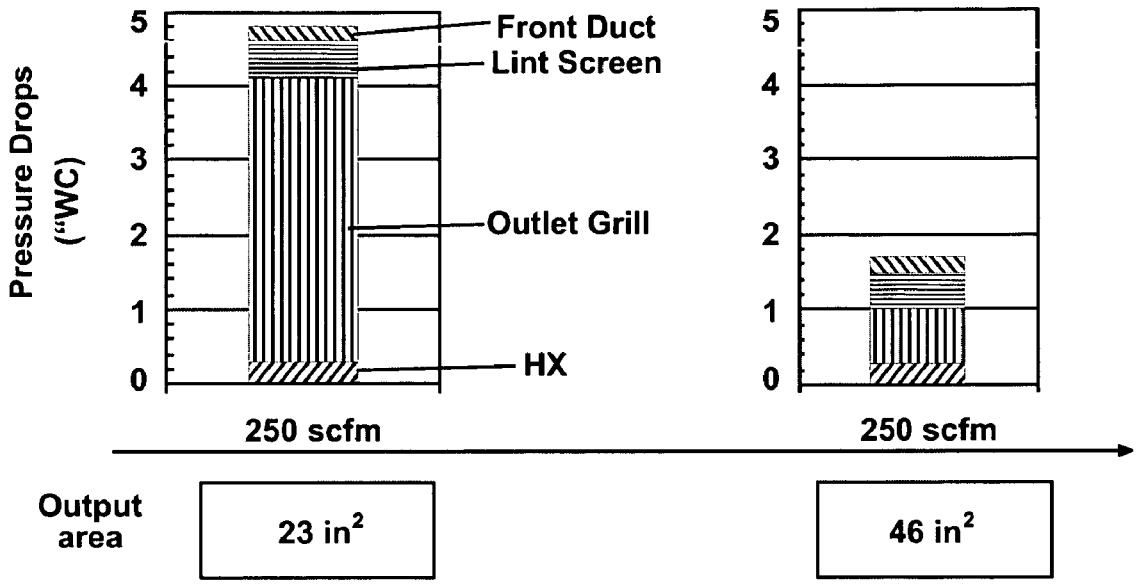
FIG. 10 graphically shows the pressure drop effect of adding a second outlet port according to the invention.

FIG. 10 shows the effect of adding a second outlet port according to the invention. This test data from an exemplary heat pump prototype shows over a 50% reduction in system pressure drop with a second outlet port spaced from the first outlet port. Higher airflow is now acceptable because the increased outlet area maintains an acceptable pressure drop and keeps blower and motor size and power to a minimum. Additionally, it has been found that division of the outlet area into spatially separated parts of the tumbling cavity minimizes clothes plastering at the outlet ports at higher airflow rates. Optimal location of at least one additional outlet port relative to the first outlet port and relative to the inlet port can improve clothes tumbling distribution, heat/mass transfer between the clothes and air, and drying uniformity resulting in lower and more uniform fabric temperatures.

Since the evaporator removes the majority of the moisture present in the air exiting the drum, this air can be recirculated back into the drum. Many heat pump dryers use such a ventless design. However, in steady state operation, the heat pump generates more heat than cooling, so some form of heat removal has been found to be helpful in heat pump dryers such as the present embodiment. Means to remove heat include (1) an air-to-air heat exchanger in the process air stream to transfer some of the heat to the exterior of the dryer, (2) a post-condenser loop in the refrigerant system so that a portion of the condenser heat is outside the process air stream; or (3) an air bleed to introduce room air into the process air and bleed off a portion of the process air into the room.

An alternative to a closed-loop system is to use an open-loop system where a portion of the process air is vented to the outdoor atmosphere, similar to a standard electric dryer. A partially-open loop system is preferred, where a portion of the process air is vented outdoors to remove excess heat. Since the venting is only needed once the system has fully warmed up, a variable venting mechanism can be used. With this approach, all of the process air is recirculated through the dryer until a predetermined mode is complete (e.g., a set temperature is achieved after warm-up). At that point, the exhaust is opened and a portion of the total airflow is vented to the outside. Employing this type of mechanism results in significant energy savings over a fully open loop approach. Exemplary results are shown in Table 1.

| Benchtop Testing - 12 lb. Towels | | |
|---|---|---|
| Vent Condition | Dry Time, minutes | Energy Consumption (kWh) |
| Closed Vent During Warmup | 58.6 | 3.58 |
| Fixed Open Vent Throughout Cycle | 60.5 | 4.05 |

When the dryer vent is closed during the warm-up period, it was found that the drum pressure was close to 0" WC. At this minimal pressure, there is a minor risk of lint migration through the seals between the tumbler and the rear and front bulkheads. However, the fabric is wet during this time period and not yet prone to linting, thereby minimizing lint migration through the drum seals during this warm-up period. This limiting effect can be enhanced by integrating a boost heater into the process air stream. A boost heater serves to increase the inlet temperature into the drum and allows the dryer to complete the warm up phase in significantly less time compared to operating with a heat pump alone.

Lint management is effected by employing a lint screen that is 1-½ times larger and utilizes a much finer mesh (85 mesh count per inch as compared to 23) than in conventional lint screens. This is found to effectively prevent excessive lint migration into the heat exchanger region.

Sensors and controls are included to operate the heat pump dryer to its fullest extent. A major sensing system identifies when to modulate the heat input. It was found that a sensing element could be cycled using a temperature measurement in the inlet duct of the dryer before the air enters the drum. This temperature is used as part of the dryer control to modulate the heating element on and off as needed. This same inlet duct temperature input is also used to identify the point in the cycle when the warm-up is complete and the vent can be opened to the outside.

Since the boost element's main function is to speed up the warm-up period associated with the heat pump system, its usefulness tends to diminish after this warm-up has occurred. Once the fabric starts to dry and the constant rate-drying period has ended, the element is no longer needed. Thus, a signal in addition to inlet duct temperature can identify this point. Options include humidity sensors, moisture conductivity strips and various additional rear duct temperature sensing locations. The preferable approach is a second duct temperature reading in the plenum 76 or just after the lint filter, upstream from the heat exchanger. It was found that the temperature difference between the plenum 76 and inlet duct temperatures provided enough information not only to decide when to cease use of the boost element, but also when to end the dry cycle and shut down the compressor. This approach was initially tested with the following three loads:

1) Extra large load as represented by 12 lbs (dry) of towels;
2) Medium or normal loads as represented by 7 lbs (dry) of cotton cloth;
3) Delicate loads as represented by 3 lbs (dry) of lingerie and nightgowns;

Prototype testing shows this approach to be very reliable and repeatable. It also shows the effectiveness of the invention The key parameters measured were total drying time, which included a cool down at the end of the cycle, total energy consumption, fabric temperature (as measured with temperature strips attached to individual pieces of clothing) and final moisture content. A load was determined to be dry if it met the manufacturers' specification for remaining moisture content (RMC).

The tables below show some of the representative results. "Market Best" refers to the electric unit currently available on the market that is believed to be the best for that load. "Heat Pump" refers to a heat pump dryer embodiment according to the invention. "Energy" is the total energy consumption in KWh for the total dry cycle for the given load. "Fabric temp" was determined by averaging the readings from 8 to 10 temperature strips attached directly to individual pieces of clothing in the load. In all cases, RMC was within allowable specifications.

Multiple tests were performed for each load according to predetermined test specifications. Initial moisture content for all loads was tightly controlled in order to make fair and consistent test comparisons between clothes dyers.

| Dryer | Time, mins | Energy | Fabric Temp. |
|---|---|---|---|
| | Delicate Load | | |
| Market Best | 22.2 | 0.74 | 120 |
| Heat Pump | 14.4 | 0.44 | 110 |
| Gain | 35% | 41% | 10° F. |
| | Medium, 7 lb cotton load | | |
| Market Best | 39 | 2.90 | 185 |

-continued

| Dryer | Time, mins | Energy | Fabric Temp. |
|---|---|---|---|
| Heat Pump | 42 | 1.97 | 155 |
| Gain | −8% | 31% | 30° F. |
| | Large, 15 lb Towel Load | | |
| Market Best | 78 | 6.28 | 190 |
| Heat Pump | 78 | 3.52 | 155 |
| Gain | — | 44% | 35° F. |

As the tables show, the heat pump dryer embodiment according to the invention delivers dry times that were similar to or faster than the market best for all loads while delivering energy savings between 30–50% with dramatically lower fabric temperatures.

At least one secondary outlet from a clothes dryer drum provides means to deliver higher airflow (while maintaining acceptable pressure drop) and improve fabric care. Higher airflow is now acceptable because the increased outlet area maintains an acceptable pressure drop and keeps blower and motor size and power to a minimum. Additionally, division of the outlet area into spatially separated parts of the tumbling cavity helps to avoid plastering or sucking of clothes to the drum outlets. Proper location of the additional outlets relative to first outlet and inlet can improve clothes tumbling distribution, heat/mass transfer between the clothes and air, and drying uniformity resulting in lower and more uniform fabric temperatures. In other words, a multiple outlet design according to the invention can provide a clothes dryer with a smaller blower/motor requiring less power, a more efficient clothes drying process within the drum, and shorter overall drying time. Although these benefits are shown in the specific embodiment of a heat pump clothes dryer, the same benefits could be achieved in any dryer which properly locates the drum inlet and a multiple outlet configuration according to the invention.

While the invention has been specifically described in connection with certain specific embodiments thereof, it is to be understood that this is by way of illustration and not of limitation, and the scope of the appended claims should be construed as broadly as the prior art will permit.

What is claimed is:

1. A clothes dryer comprising:

a heat pump;

a drum, an inlet in the drum fluidly connecting the heat pump to the drum;

first and second outlets, each covered by a grill in the drum, and spaced from each other and from the inlet to exhaust air from the drum; and a fan for generating a flow of air from the heat pump into the drum through the inlet and out of the drum through the first and second outlets, whereby the velocity of flow of air can be increased through the drum with minimal pressure drop between the inlet and the outlets to accelerate drying clothes in the drum with less plastering of clothes against the grill at one of the first and second outlets.

2. The clothes dryer of claim 1 wherein the sum of the cross sectional areas of the first and second outlets is greater than the cross sectional area of the inlet.

3. The clothes dryer of claim 2 wherein the sum of the cross sectional areas of the first and second outlets is at least twice the cross sectional area of the inlet.

4. The clothes dryer of claim 1 wherein the first and second outlets are fluidly connected outside the drum to a common plenum.

5. The clothes dryer of claim 4 wherein the sum of the cross sectional areas of the first and second outlets is greater than the cross sectional area of the inlet.

6. The clothes dryer of claim 5 wherein the sum of the cross sectional areas of the first and second outlets is at least twice the cross sectional area of the inlet.

7. The clothes dryer according to claim 1, further comprising:

a lint filter disposed in the flow of air downstream from the first and second outlets.

8. The clothes dryer according to claim 7, wherein the sum of the cross sectional areas of the first and second outlets is greater than the cross sectional area of the inlet.

9. The clothes dryer according to claim 8, wherein the sum of the cross sectional areas of the first and second outlets is at least twice the cross sectional area of the inlet.

10. A clothes dryer according to claim 7, wherein the first and second outlets are fluidly connected outside the drum to a common plenum before flowing through the lint filter.

11. The clothes dryer according to claim 1, wherein the drum further comprises:

a front bulkhead containing the first outlet;

a rear bulkhead containing the second outlet; and a rotatable tumbler intermediate the rear and front bulkheads.

12. The clothes dryer according to claim 11, wherein the sum of the cross sectional areas of the first and second outlets is greater than the cross sectional area of the inlet.

13. The clothes dryer according to claim 12, wherein the sum of the cross sectional areas of the first and second outlets is at least twice the cross sectional area of the inlet.

14. A clothes dryer according to claim 7, further comprising:

a duct disposed outside the drum for fluidly connecting the flow of air exiting the first and second outlets, wherein the air exiting the first and second outlets is combined before flowing through the lint filter.

15. The clothes dryer according to claim 14, wherein the sum of the cross sectional areas of the first and second outlets is greater than the cross sectional area of the inlet.

16. The clothes dryer according to claim 15, wherein the sum of the cross sectional areas of the first and second outlets is at least twice the cross sectional area of the inlet.

17. The clothes dryer according to claim 1 wherein the rate of the flow of air is about 250 cfm.

18. The clothes dryer according to claim 1 wherein the flow of air is in a closed-loop system.

19. The clothes dryer according to claim 1 wherein the flow of air is in an open-loop system.

20. The clothes dryer according to claim 11 wherein the inlet is in the rear bulkhead.

* * * * *